US011028757B2

(12) United States Patent
Umemoto

(10) Patent No.: US 11,028,757 B2
(45) Date of Patent: Jun. 8, 2021

(54) EXHAUST PURIFICATION SYSTEM OF INTERNAL COMBUSTION ENGINE

(71) Applicant: TOYOTA JIDOSHA KABUSHIKI KAISHA, Toyota (JP)

(72) Inventor: Kazuhiro Umemoto, Ebina (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 31 days.

(21) Appl. No.: 16/538,880

(22) Filed: Aug. 13, 2019

(65) Prior Publication Data

US 2020/0080458 A1 Mar. 12, 2020

(30) Foreign Application Priority Data

Sep. 6, 2018 (JP) ..... JP2018-166988

(51) Int. Cl.
*F01N 9/00* (2006.01)
*F01N 3/08* (2006.01)

(52) U.S. Cl.
CPC ..... *F01N 9/00* (2013.01); *F01N 3/0814* (2013.01); *F01N 3/0864* (2013.01); *F01N 2430/04* (2013.01); *F01N 2430/06* (2013.01)

(58) Field of Classification Search
CPC ..... F01N 9/00; F01N 3/0814; F01N 3/0864; F01N 2430/04; F01N 2430/06
USPC ..... 60/286
See application file for complete search history.

(56) References Cited

U.S. PATENT DOCUMENTS 5,941,211 A 8/1999 Brehob et al.
6,370,872 B1 * 4/2002 Watanabe ..... F01N 3/0814 60/288
6,378,298 B2 * 4/2002 Harima ..... F01N 3/0814 60/286
6,502,391 B1 * 1/2003 Hirota ..... F01N 3/0814 60/288
6,622,478 B2 * 9/2003 Nakamura ..... F01N 3/0814 60/285
6,751,950 B2 * 6/2004 Ikemoto ..... F02D 41/1441 60/285
2001/0013221 A1 8/2001 Suzuki et al.
2014/0060016 A1 * 3/2014 Sato ..... F02D 41/1441 60/286
2014/0318496 A1 10/2014 Yoshida et al.
2016/0258373 A1 * 9/2016 Tanaka ..... F01N 3/0842
(Continued)

FOREIGN PATENT DOCUMENTS

EP 3 351 780 A1 7/2018
JP 2018-009535 A 1/2018

*Primary Examiner* — Thai Ba Trieu
(74) *Attorney, Agent, or Firm* — Oliff PLC

(57) ABSTRACT

An exhaust purification system of an internal combustion engine is provided with: an exhaust purification catalyst supporting a precious metal and able to store oxygen; and a control device controlling an amount of fuel fed to a combustion chamber. When a predetermined condition for performing a fuel cut operation stands, the control device is configured to perform fuel feed control in which fuel is temporarily fed to the combustion chamber so that the air-fuel ratio of the exhaust gas flowing into the exhaust purification catalyst is a rich air-fuel ratio richer than the stoichiometric air-fuel ratio, then start fuel cut control stopping the feed of fuel to the combustion chamber in the state the internal combustion engine is operating.

9 Claims, 10 Drawing Sheets

(56) References Cited

U.S. PATENT DOCUMENTS

| | | | | |
|---|---|---|---|---|
| 2016/0273466 | A1* | 9/2016 | Nakagawa | F01N 3/0864 |
| 2018/0017001 | A1 | 1/2018 | Ito et al. | |
| 2020/0063679 | A1* | 2/2020 | Oda | F01N 3/0842 |

* cited by examiner

EXHAUST PURIFICATION SYSTEM OF INTERNAL COMBUSTION ENGINE

FIELD

The present invention relates to an exhaust purification system of an internal combustion engine.

BACKGROUND

Known in the past has been an internal combustion engine able to perform fuel cut control stopping a feed of fuel to a combustion chamber in the state where the internal combustion engine is operating, for example, at the time of deceleration of a vehicle mounting the internal combustion engine. In addition, an exhaust purification system of an internal combustion engine provided with an exhaust purification catalyst supporting palladium or another precious metal in an exhaust passage of the internal combustion engine is known. It is known that in such an exhaust purification catalyst, if fuel cut control is performed in a state of a high temperature of the exhaust purification catalyst, the precious metal supported on the exhaust purification catalyst is liable to deteriorate (for example, PTL 1).

Therefore, in the exhaust purification system described in PTL 1, an exhaust shut valve is provided in an exhaust passage of the internal combustion engine and an EGR mechanism returning part of the exhaust gas flowing through the exhaust passage to the intake passage is provided. When the temperature of the exhaust purification catalyst is high, the throttle valve is closed, the shut valve is closed, and the EGR mechanism is used to make part of the exhaust gas flow into the intake passage. Due to this, even during a fuel cut operation, only EGR gas flows into the engine body, therefore the concentration of oxygen in the exhaust gas can be kept low and accordingly it is considered that the precious metal supported at the exhaust purification catalyst can be kept from deteriorating. In addition, it is considered that by closing the shut valve, the pumping loss becomes greater and accordingly the driver can obtain a feeling of deceleration.

CITATION LIST

Patent Literature

[PTL 1] Japanese Unexamined Patent Publication No. 2018-009535

SUMMARY

Technical Problem

In this regard, in the exhaust purification system described in PTL 1, high concentration EGR gas is fed into the combustion chamber during a fuel cut operation. Therefore, even when returning to normal operation after the end of a fuel cut operation, EGR gas fills the inside of the combustion chamber and thus combustion cannot be started immediately even if feeding fuel into the combustion chamber. Therefore, in the exhaust purification system described in PTL 1, it takes time to return to normal operation after a fuel cut operation. In addition, in the exhaust purification system described in PTL 1, it becomes necessary to set an exhaust shut valve inside the exhaust passage, therefore the manufacturing cost increases. Therefore, there is room for improvement in the exhaust purification catalyst described in PTL 1.

On the other hand, according to research of the inventors, it was learned that one reason for deterioration of the precious metal is the reaction on the precious metal between the HC adsorbed on the precious metal and the oxygen flowing into the exhaust purification catalyst during fuel cut control, and thus local generation of heat by the precious metal.

In consideration of the above technical problem, an object of the present disclosure is to provide an exhaust purification system able to keep the precious metal from locally generating heat and keep the precious metal from deteriorating.

Solution to Problem

The present invention was made so as to solve the above problem and has as its gist the following.

(1) An exhaust purification system of an internal combustion engine, comprising: an exhaust purification catalyst supporting a precious metal and able to store oxygen; and a control device controlling an amount of fuel fed to a combustion chamber, wherein when a predetermined condition for performing a fuel cut operation stands, the control device is configured to perform fuel feed control in which fuel is temporarily fed to the combustion chamber so that the air-fuel ratio of the exhaust gas flowing into the exhaust purification catalyst is a rich air-fuel ratio richer than the stoichiometric air-fuel ratio, then start fuel cut control stopping the feed of fuel to the combustion chamber in the state the internal combustion engine is operating.

(2) The exhaust purification system of the internal combustion engine according to above (1), wherein the control device is configured to control the amount of feed of fuel to the combustion chamber so that the total amount of feed of fuel during the fuel feed control is greater, when the oxygen storage amount of the exhaust purification catalyst when the condition for performing a fuel cut operation stands is relatively large, compared to when it is relatively small.

(3) The exhaust purification system of the internal combustion engine according to above (2), wherein the control device is configured to control the amount of feed of fuel to the combustion chamber so that the rich degree of the air-fuel ratio of the exhaust gas flowing into the exhaust purification catalyst during the fuel feed control is greater, when the oxygen storage amount of the exhaust purification catalyst when the condition for performing a fuel cut operation stands is relatively large, compared to when it is relatively small.

(4) The exhaust purification system of the internal combustion engine according to any one of above (1) to (3), wherein the control device is configured to perform the fuel cut control without performing the fuel feed control even if the condition for performing the fuel cut operation stands, if the oxygen storage amount of the exhaust purification catalyst when the condition for performing the fuel cut operation stands is smaller than a predetermined reference oxygen storage amount the maximum storable oxygen amount of the exhaust purification catalyst and smaller than greater than zero.

(5) The exhaust purification system of the internal combustion engine according to any one of above (1) to (4), wherein the control device is configured to control the amount of feed of fuel to the combustion chamber so that the total amount of feed of fuel during the fuel feed control becomes smaller, when the degree of deterioration of the exhaust purification catalyst when the condition for performing a fuel cut operation stands is relatively large, compared to when it is relatively small.

(6) The exhaust purification system of the internal combustion engine according to any one of above (1) to (5), wherein the control device is configured to perform the fuel cut control without performing the fuel feed control if the amount of adsorption of hydrocarbons at the exhaust purification catalyst when the condition for performing the fuel cut operation stands is equal to or greater than a predetermined reference adsorption amount.

(7) The exhaust purification system of the internal combustion engine according to above (6), wherein the control device is configured to control the feed of fuel to the combustion chamber so that the greater the amount of adsorption of hydrocarbons at the exhaust purification catalyst, the smaller the rich degree of the air-fuel ratio of the exhaust gas flowing into the exhaust purification catalyst during the fuel feed control becomes, if the amount of adsorption of hydrocarbons at the exhaust purification catalyst when the condition for performing the fuel cut operation stands is less than the reference adsorption amount.

Advantageous Effects of Invention

According to the present disclosure, an exhaust purification system able to keep precious metal from locally generating heat and keep the precious metal from deteriorating is provided.

DESCRIPTION OF EMBODIMENT

Figure 1:
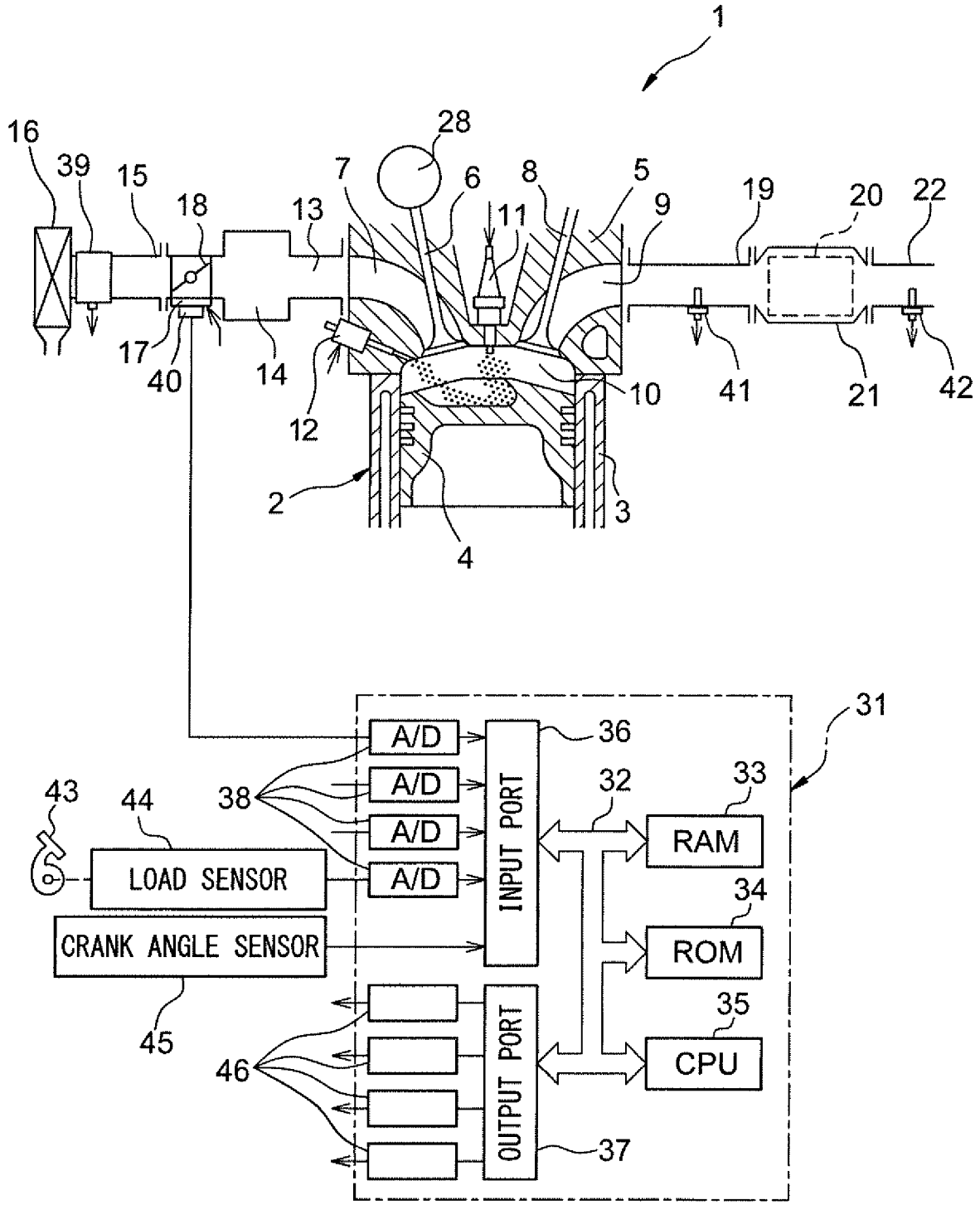
FIG. 1 is a view schematically showing an internal combustion engine in which an exhaust purification system according to one embodiment is used.

Below, referring to the drawings, embodiments of the present invention will be explained in detail. Note that, in the following explanation, similar component elements are assigned the same reference numerals.

First Embodiment

<<Explanation of Internal Combustion Engine as a Whole>>

FIG. 1 is a view which schematically shows an internal combustion engine in which an exhaust purification system according to a first embodiment of the present invention is used. As shown in FIG. 1, an internal combustion engine 1 includes an engine body 2, a cylinder block 3, a piston 4 which reciprocates inside the cylinder block 3, a cylinder head 5 which is fastened to the cylinder block 3, an intake valve 6, an intake port 7, an exhaust valve 8, and an exhaust port 9. A combustion chamber 10 is formed between the piston 4 and the cylinder head 5. The intake valve 6 opens and closes the intake port 7, while the exhaust valve 8 opens and closes the exhaust port 9. Further, the engine body 2 is provided with a variable valve timing mechanism 28 which controls a valve timing of the intake valve 6. Note that, the engine body 2 may be provided with a variable valve timing mechanism which controls a valve timing of the exhaust valve 8.

As shown in FIG. 1, a spark plug 11 is arranged at a center part of an inside wall surface of the cylinder head 5, while a fuel injector 12 is arranged at a side part of the inner wall surface of the cylinder head 5. The spark plug 11 is configured to generate a spark in accordance with an ignition signal. Further, the fuel injector 12 injects a predetermined amount of fuel into the combustion chamber 10 in accordance with an injection signal. Note that, the fuel injector 12 may also be arranged so as to inject fuel into the intake port 7, as long as able to supply fuel into the combustion chamber 10.

The intake port 7 of each cylinder is connected to a surge tank 14 through a corresponding intake runner 13, while the surge tank 14 is connected to an air cleaner 16 through an intake pipe 15. The intake port 7, intake runner 13, surge tank 14, and intake pipe 15 form an intake passage. Further, inside the intake pipe 15, a throttle valve 18 which is driven by a throttle valve drive actuator 17 is arranged.

On the other hand, the exhaust port 9 of each cylinder is connected to an exhaust manifold 19, which is connected to an upstream side casing 21 which houses an exhaust purification catalyst 20. The upstream side casing 21 is connected to an exhaust pipe 22. The exhaust port 9, exhaust manifold 19, upstream side casing 21 and exhaust pipe 22 form an exhaust passage.

In addition, the internal combustion engine 1 is provided with an electronic control unit (ECU) 31. ECU 31 is comprised of a digital computer which is provided with components which are connected together through a bidirectional bus 32 such as a RAM (random access memory) 33, ROM (read only memory) 34, CPU (microprocessor) 35, input port 36, and output port 37.

In the intake pipe 15, an air flow meter 39 is arranged for detecting the flow rate of air which flows through the intake pipe 15. At the throttle valve 18, a throttle valve opening sensor 40 is arranged for detecting an opening degree of the throttle valve 18. In addition, at the exhaust manifold 19 in the upstream side of the exhaust purification catalyst 20 in the flow direction of exhaust, an upstream side air-fuel ratio sensor 41 is provided, which detects the air-fuel ratio of the exhaust gas flowing through the exhaust manifold 19 (that is, the exhaust gas flowing into the exhaust purification catalyst 20). Further, in the exhaust pipe 22 in the downstream side of the exhaust purification catalyst 20 in the flow direction of exhaust, a downstream side air-fuel ratio sensor 42 is provided, which detects the air-fuel ratio of the exhaust gas flowing through the exhaust pipe 22 (that is, the exhaust gas flowing out from the exhaust purification catalyst 20 and flows into the downstream side exhaust purification catalyst 24). The outputs of the air flow meter 39, throttle opening sensor 40, upstream side air-fuel ratio sensor 40, and downstream side air-fuel ratio sensor 41 are input through the corresponding AD converters 38 to the input port 36.

Further, a load sensor 44 generating an output voltage proportional to the amount of depression of the accelerator pedal 43 is connected to the accelerator pedal 43. The output voltage of the load sensor 44 is input through a corresponding AD converter 38 to the input port 36. The crank angle sensor 45, for example, generates an output pulse every time the crank shaft rotates by 15 degrees. This output pulse is input to the input port 36. At the CPU 35, the engine speed is calculated from the output pulse of this crank angle sensor 45.

On the other hand, the output port 37 is connected through corresponding drive circuits 46 to the spark plugs 11, fuel injectors 12, throttle valve drive actuator 17, and variable valve timing mechanism 28. Therefore, ECU 31 functions as a control device for controlling an ignition timing of the ignition plug 11, fuel injection timing or amount from the fuel injector 12, opening degree of the throttle valve 18 and valve timing of the intake valve 6.

In the present embodiment, the control device controls an air-fuel ratio of the exhaust gas flowing out from the engine body 2, i.e., the exhaust gas flowing into the exhaust purification catalyst 20, by adjusting the fuel injection amount from the fuel injector 12. When changing the air-fuel ratio of the exhaust gas flowing out from the engine body 2 to the rich side, the fuel injection amount from the fuel injector 12 is increased, while when changing the air-fuel ratio of the exhaust gas flowing out from the engine body 2 to the lean side, the fuel injection amount from the fuel injector 12 is decreased.

<<Explanation of Exhaust Purification Catalyst>>

The exhaust purification catalyst 20 is a three-way catalyst which has an oxygen storage ability. Specifically, the exhaust purification catalyst is a three-way catalyst which comprises a carrier made of ceramic on which a precious metal (for example, platinum Pt) having a catalyst effect and a substance having an oxygen storage ability (for example, ceria $CeO_2$) are carried. A three-way catalyst has the function of simultaneously purifying unburned HC, CO and $NO_X$ when the air-fuel ratio of the exhaust gas flowing into the three-way catalyst is maintained at the stoichiometric air-fuel ratio. In addition, when the exhaust purification catalyst 20 stores a certain extent of oxygen, the unburned HC and CO and $NO_X$ are simultaneously purified even if the air-fuel ratio of the exhaust gas flowing into the exhaust purification catalyst 20 somewhat deviates from the stoichiometric air-fuel ratio to the rich side or lean side.

Accordingly, if the exhaust purification catalyst 20 has an oxygen storage ability, that is, if the oxygen storage amount of the exhaust purification catalyst 20 is less than the maximum storage oxygen amount, when the air-fuel ratio of the exhaust gas flowing into the exhaust purification catalyst 20 is somewhat leaner than the stoichiometric air-fuel ratio, the excess oxygen contained in the exhaust gas is stored in the exhaust purification catalyst 20. Therefore, the surfaces of the exhaust purification catalyst 20 are maintained at the stoichiometric air-fuel ratio. As a result, on the surfaces of the exhaust purification catalyst 20, the unburned HC, CO and $NO_X$ are simultaneously purified. At this time, the air-fuel ratio of the exhaust gas flowing out from the exhaust purification catalyst 20 is the stoichiometric air-fuel ratio.

On the other hand, if exhaust purification catalyst 20 can release oxygen, that is, the oxygen storage amount of the exhaust purification catalyst 20 is more than zero, when the air-fuel ratio of the exhaust gas flowing into the exhaust purification catalyst 20 is somewhat richer than the stoichiometric air-fuel ratio, the oxygen which is insufficient for reducing the unburned HC and CO contained in the exhaust gas, is released from the exhaust purification catalyst 20. Therefore, the surfaces of the exhaust purification catalyst 20 are maintained at the stoichiometric air-fuel ratio. As a result, on the surfaces of the exhaust purification catalyst 20, the unburned HC, CO and $NO_X$ are simultaneously purified. At this time, the air-fuel ratio of the exhaust gas flowing out from the exhaust purification catalyst is the stoichiometric air-fuel ratio.

In this way, when the exhaust purification catalyst 20 stores a certain extent of oxygen, even if the air-fuel ratio of the exhaust gas flowing into the exhaust purification catalyst 20 deviates somewhat from the stoichiometric air-fuel ratio to the rich side or lean side, the unburned HC, CO and $NO_X$ are simultaneously purified and the air-fuel ratio of the exhaust gas flowing out from the exhaust purification catalyst 20 is the stoichiometric air-fuel ratio.

<<Deterioration of Catalyst During Fuel Cut Control>>

In this regard, in the internal combustion engine 1 according to the present embodiment, when the vehicle mounting the internal combustion engine 1 is decelerating, fuel cut control, in which the injection of fuel from the fuel injector 12 is stopped in the state while the internal combustion engine 1 is operating, is performed. If such fuel cut control is performed, the air flowing into the combustion chamber 10 flows out as is from the combustion chamber 10, therefore air flows into the exhaust purification catalyst 20.

If air flows into the exhaust purification catalyst 20 in this way, the exhaust purification catalyst 20 deteriorates. One of the reasons why the exhaust purification catalyst 20 deteriorates has been elucidated, therefore below the reason for deterioration will be explained while referring to FIG. 2.

Figure 2:
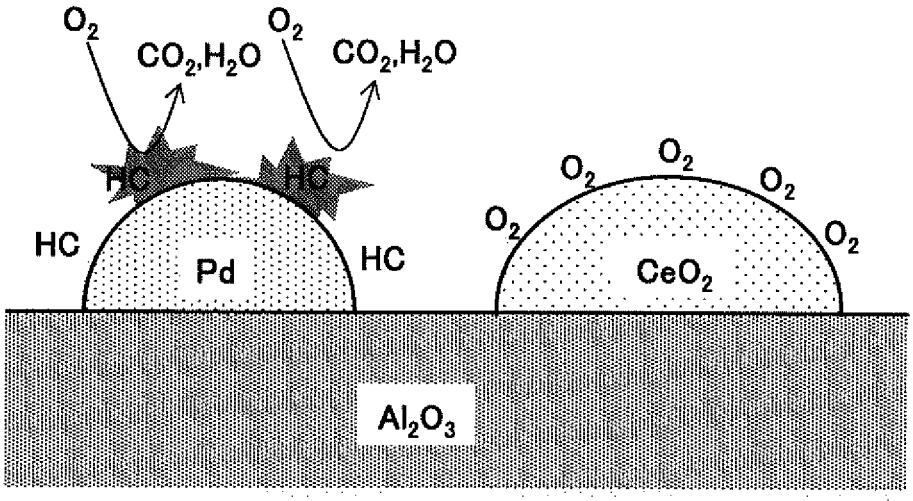
FIG. 2 is a schematic cross-sectional view schematically showing a surface of a support of the exhaust purification catalyst.

FIG. 2 is a schematic cross-sectional view schematically showing a surface of a support of the exhaust purification catalyst 20. In the example shown in FIG. 2, a support including alumina ($A1_2O_3$) supports the precious metal palladium (Pd) and ceria ($CeO_2$) functioning as an oxygen storing agent.

As explained above, exhaust gas discharged from the engine body 2 and flowing into the exhaust purification catalyst 20 contains unburned HC, CO, and NOx. Among these constituents, unburned HC is adsorbed on the precious metal when the temperature of the exhaust purification catalyst 20 is low.

If in this way fuel cut control is performed and thus a large amount of oxygen flows into the exhaust purification catalyst 20 in the state where unburned HC is adsorbed on the precious metal, part of the inflowing oxygen reacts with the unburned HC adsorbed on the precious metal. Due to this reaction, carbon dioxide and water are generated. Such a reaction is an exothermic reaction, therefore the precious metal is locally heated.

Almost all of the heat of reaction at this time is used for heating the precious metal, therefore the temperature of the precious metal becomes extremely high. As a result, the precious metal is sintered. If the precious metal is sintered, the total surface area of the precious metal becomes smaller. As a result, the catalytic action due to the precious metal falls, that is, the exhaust purification catalyst 20 deteriorates.

<<Suppression of Deterioration of Catalyst>>

If considering this mechanism of deterioration of the exhaust purification catalyst 20, to keep the exhaust purification catalyst 20 from deteriorating during fuel cut control, it may be considered to keep the unburned HC adsorbed at the precious metal and the oxygen from rapidly reacting during fuel cut control. Below, referring to FIGS. 3A and 3B, the mechanism for keeping the exhaust purification catalyst 20 from deteriorating during fuel cut operation will be explained.

Figure 3A:
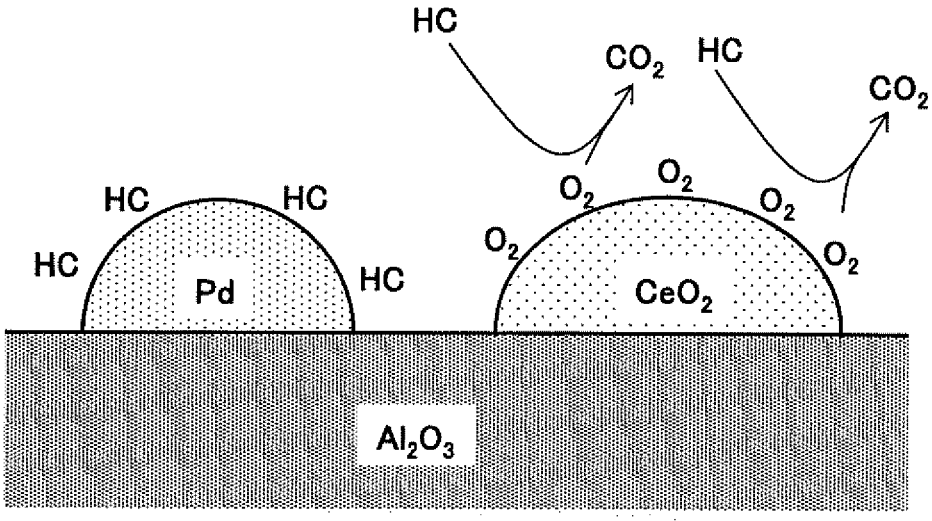
FIGS. 3A and 3B are schematic cross-sectional views similar to FIG. 2 schematically showing a surface of a support of the exhaust purification catalyst.
Figure 3B:
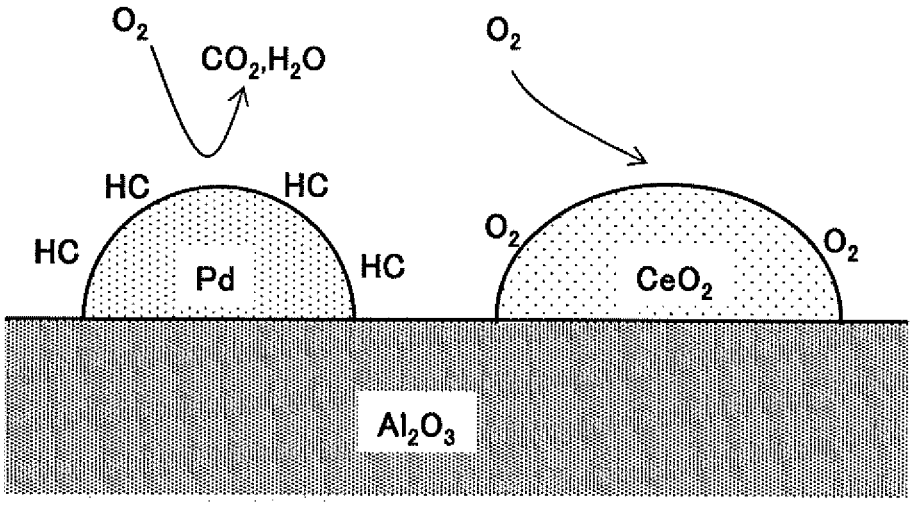

FIGS. 3A and 3B are schematic cross-sectional views similar to FIG. 2 schematically showing the surface of the support of the exhaust purification catalyst 20. FIG. 3A shows the state of the support surface when exhaust gas of an air-fuel ratio richer than the stoichiometric air-fuel ratio (below, also referred to as a "rich air-fuel ratio") flows into the exhaust purification catalyst 20, while FIG. 3B shows the state of the support surface when air flows into the exhaust purification catalyst 20 due to fuel cut control.

As shown in FIG. 3A, if making the air-fuel ratio of the exhaust gas flowing into the exhaust purification catalyst 20 a rich air-fuel ratio, the oxygen partial pressure in the exhaust gas is low, therefore the oxygen stored in the oxygen storing agent of the exhaust purification catalyst 20 is released into the exhaust gas. The oxygen released into the exhaust gas reacts with the unburned HC or CO in the exhaust gas and the oxygen partial pressure in the exhaust gas remains low. As a result, the oxygen storage amount of the oxygen storing agent decreases and the amount of oxygen which the oxygen storing agent can store increases.

In this way, if fuel cut control is started in the state where the amount of oxygen which the oxygen storing agent can store is increased, as shown in FIG. 3B, part of the oxygen flowing into the exhaust purification catalyst 20 is stored in the oxygen storing agent. As a result, the amount of oxygen reacting with the unburned HC adsorbed at the precious metal becomes smaller and, accordingly, the precious metal is no longer excessively raised in temperature. Therefore, the precious metal is kept from sintering and the exhaust purification catalyst 20 is kept from deteriorating.

<<Control at Time of Fuel Cut Operation>>

Therefore, in the present embodiment, when a predetermined condition for performing fuel cut operation stands, the control device starts fuel cut control after performing fuel feed control temporarily feeding fuel to the combustion chamber 10 so that the air-fuel ratio of the exhaust gas flowing into the exhaust purification catalyst 20 is a rich air-fuel ratio. Further, in the present embodiment, if the oxygen storage amount of the exhaust purification catalyst 20 when the condition for performing the fuel cut operation stands is smaller than a predetermined reference oxygen storage amount, which is smaller than the maximum storable oxygen amount (the maximum value of oxygen which the exhaust purification catalyst 20 can store) and greater than zero, the control device performs fuel cut control without performing the fuel feed control even if the condition for performing fuel cut operation stands. Below, this control will be specifically explained.

Figure 4:
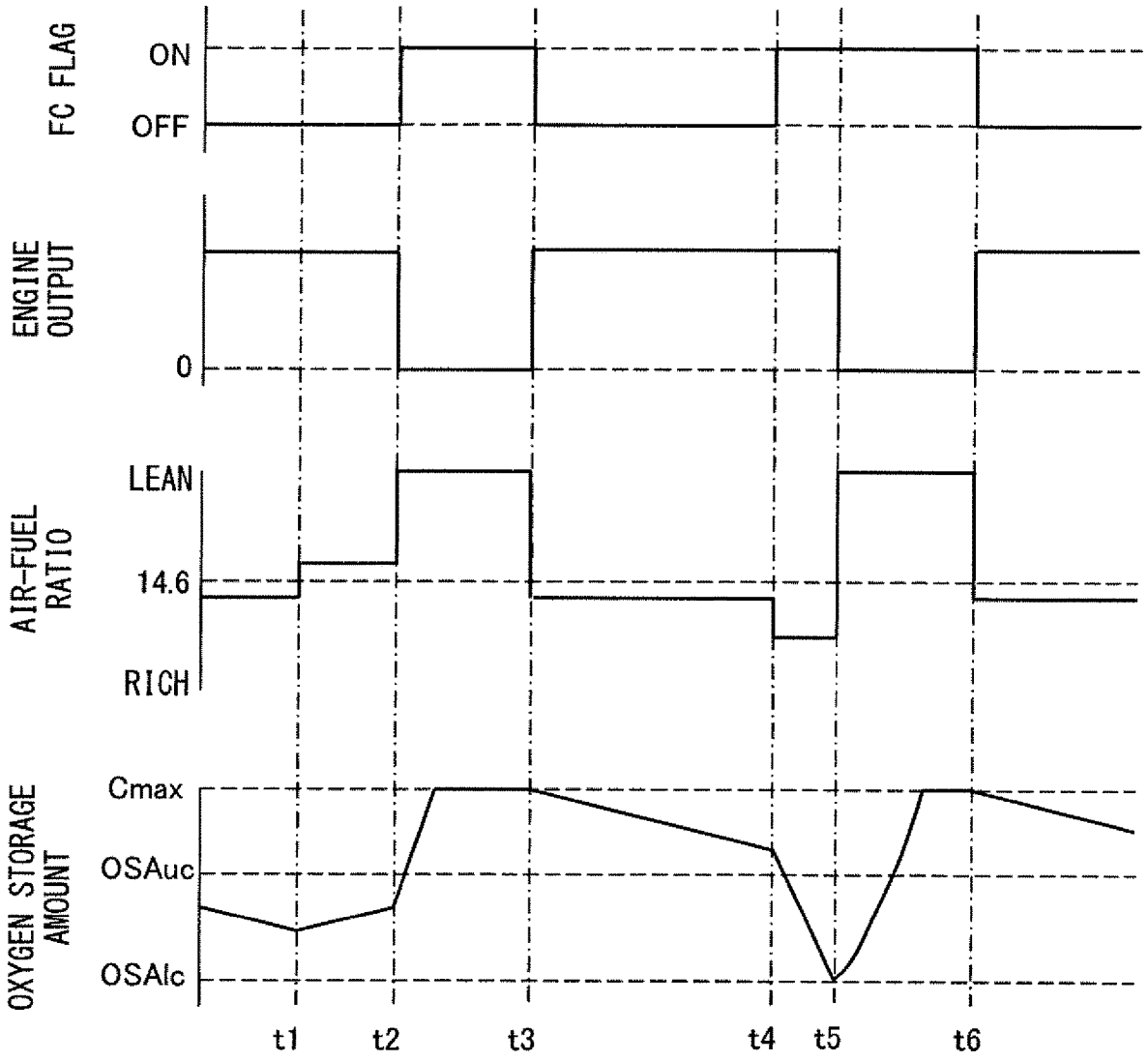
FIG. 4 is a time chart of an FC flag, an output of the internal combustion engine, an air-fuel ratio of exhaust gas, and an oxygen storage amount of the exhaust purification catalyst when fuel cut control is performed.

FIG. 4 is a time chart of an FC flag, an output of the internal combustion engine 1, an air-fuel ratio of exhaust gas flowing into the exhaust purification catalyst 20, and an oxygen storage amount of the exhaust purification catalyst 20, at the time when fuel cut control is performed. The FC flag is a flag which is set ON if the condition for starting fuel cut control stands and is set OFF if the condition for ending fuel cut control stands. In the illustrated example, the stoichiometric air-fuel ratio of the exhaust gas is 14.6.

In the example shown in FIG. 4, before the timing t2, usual air-fuel ratio control is performed. In the air-fuel ratio control of the present embodiment, the air-fuel ratio of the exhaust gas flowing into the exhaust purification catalyst 20 is controlled so that the oxygen storage amount OSA of the exhaust purification catalyst 20 is maintained in the vicinity of a predetermined oxygen storage amount, which is smaller than the maximum storable oxygen amount and greater than zero. In the present embodiment, the air-fuel ratio of the exhaust gas flowing into the exhaust purification catalyst 20 is controlled to alternately change between an air-fuel ratio slightly richer than the stoichiometric air-fuel ratio (timings t0 to t1) and an air-fuel ratio slightly leaner than the stoichiometric air-fuel ratio (timings t1 to t2).

Note that, the usual air-fuel ratio control shown in FIG. 4 is one example. As the usual air-fuel ratio control, another mode of air-fuel ratio control may be performed. Specifically, for example, in the usual air-fuel ratio control, the control device may control the air-fuel ratio of the exhaust gas flowing into the exhaust purification catalyst 20 to constantly be the stoichiometric air-fuel ratio. Alternatively, in usual air-fuel ratio control, the control device may control so as to switch the air-fuel ratio of the exhaust gas flowing into the exhaust purification catalyst 20 from a rich air-fuel ratio to a lean air-fuel ratio when the oxygen storage amount of the exhaust purification catalyst 20 becomes substantially zero and to switch it from a lean air-fuel ratio to a rich air-fuel ratio when the oxygen storage amount of the exhaust purification catalyst 20 becomes substantially the maximum possible storage amount.

In the illustrated figure, at the timing t2, the condition for performing fuel cut control stands. At this time, in the illustrated example, the oxygen storage amount of the exhaust purification catalyst 20 is smaller than the reference oxygen storage amount OSAuc. Therefore, even if fuel cut control is started in this state, part of the oxygen flowing into the exhaust purification catalyst 20 is stored at the oxygen storing agent of the exhaust purification catalyst 20. As a result, the reaction rate of unburned HC adsorbed on the precious metal of the exhaust purification catalyst 20 and oxygen is slow and accordingly the possibility of the precious metal being excessively raised in temperature is low.

For this reason, if at the timing t2 the condition for performing fuel cut control stands, fuel cut control is started immediately without performing fuel feed control. As a result, the air-fuel ratio of the exhaust gas flowing into the exhaust purification catalyst 20 becomes extremely high, and the oxygen storage amount of the exhaust purification catalyst 20 rapidly increases and immediately reaches the maximum storable oxygen amount Cmax. If the oxygen storage amount of the exhaust purification catalyst 20 reaches the maximum storable oxygen amount Cmax, the exhaust purification catalyst 20 can no longer store any more oxygen.

After that, if at timing t3 the condition for ending fuel cut control stands, the fuel cut control is ended. Therefore, after the timing t3, fuel injection from the fuel injector 12 is restarted and the engine output is increased from zero.

If fuel cut control is performed, the oxygen storage amount of the exhaust purification catalyst 20 reaches the maximum storable oxygen amount, therefore after fuel cut control ends, the air-fuel ratio of the exhaust gas flowing into the exhaust purification catalyst 20 is controlled to be a rich air-fuel ratio. As a result, in the illustrated example, after the timing t3, the oxygen storage amount of the exhaust purification catalyst 20 gradually decreases.

In the illustrated example, at the timing t4, the condition for performing fuel cut control again stands. At this time, the oxygen storage amount of the exhaust purification catalyst 20 is greater than the reference oxygen storage amount OSAuc. Therefore, if fuel cut control is started in this state, most of the oxygen flowing into the exhaust purification catalyst 20 reacts with the unburned HC adsorbed on the precious metal of the exhaust purification catalyst 20. Therefore, the reaction rate of unburned HC and oxygen is fast and therefore the precious metal is excessively raised in temperature and there is a high possibility of sintering of the precious metal ending up being invited.

For this reason, if at the timing t4 the condition for performing fuel cut control stands, fuel feed control is performed for temporarily feeding fuel to the combustion chamber 10 so that the air-fuel ratio of the exhaust gas flowing into the exhaust purification catalyst 20 becomes a rich air-fuel ratio before fuel cut control is started. In particular, in the present embodiment, the air-fuel ratio of the exhaust gas flowing into the exhaust purification catalyst 20 while performing fuel feed control is set to a predetermined constant air-fuel ratio richer than the rich air-fuel ratio able to be taken when usual air-fuel ratio control is being performed. For this reason, the air-fuel ratio of the exhaust gas flowing into the exhaust purification catalyst 20 is controlled so that a rich degree (difference from stoichiometric air-fuel ratio in rich direction) becomes greater after the timing t4 when fuel feed control is started compared with before the timing t4 when usual air-fuel ratio control is performed.

If at the timing t4 fuel feed control is started, the oxygen storage amount of the exhaust purification catalyst 20 decreases. In the present embodiment, at the timing t5 when a predetermined time has elapsed from the start of fuel feed control (or the internal combustion engine has been driven for a predetermined number of cycles), the fuel feed control is ended. The time (or the crank angle) for performing fuel feed control is set to a certain time (or crank angle) predetermined so that the oxygen storage amount becomes at least less than the reference oxygen storage amount OSAuc regardless of the oxygen storage amount at the time of start of fuel feed control.

At the same time as the fuel feed control ended at the timing t5, fuel cut control is started. As a result, the oxygen storage amount of the exhaust purification catalyst 20 rapidly increases and immediately reaches the maximum storable oxygen amount Cmax. After that, if, at the timing t6, the condition for ending fuel cut control stands, the fuel cut control is ended. Therefore, after the timing t6, fuel injection from the fuel injector 12 is restarted and the engine output is increased from zero.

In the present embodiment, when the oxygen storage amount of the exhaust purification catalyst 20 is large, fuel cut control is started after performing fuel feed control to reduce the oxygen storage amount once. For this reason, even if fuel cut control is started, part of the oxygen flowing into the exhaust purification catalyst 20 is stored at the oxygen storing agent. As a result, it is possible to keep the amount of oxygen reacting with the unburned HC adsorbed on the precious metal small and accordingly possible to keep the exhaust purification catalyst 20 from deteriorating.

On the other hand, when the oxygen storage amount of the exhaust purification catalyst 20 is small, fuel cut control is started without performing fuel feed control. At this time, even if not performing fuel feed control, if fuel cut control is started, part of the oxygen flowing into the exhaust purification catalyst 20 is stored in the oxygen storing agent, therefore the exhaust purification catalyst 20 can be kept from deteriorating. In addition, by not performing fuel feed control, it is possible to start fuel cut control immediately if the condition for performing the fuel cut operation stands, therefore the response of the vehicle operation can be raised.

<<Specific Control>>

Figure 5:
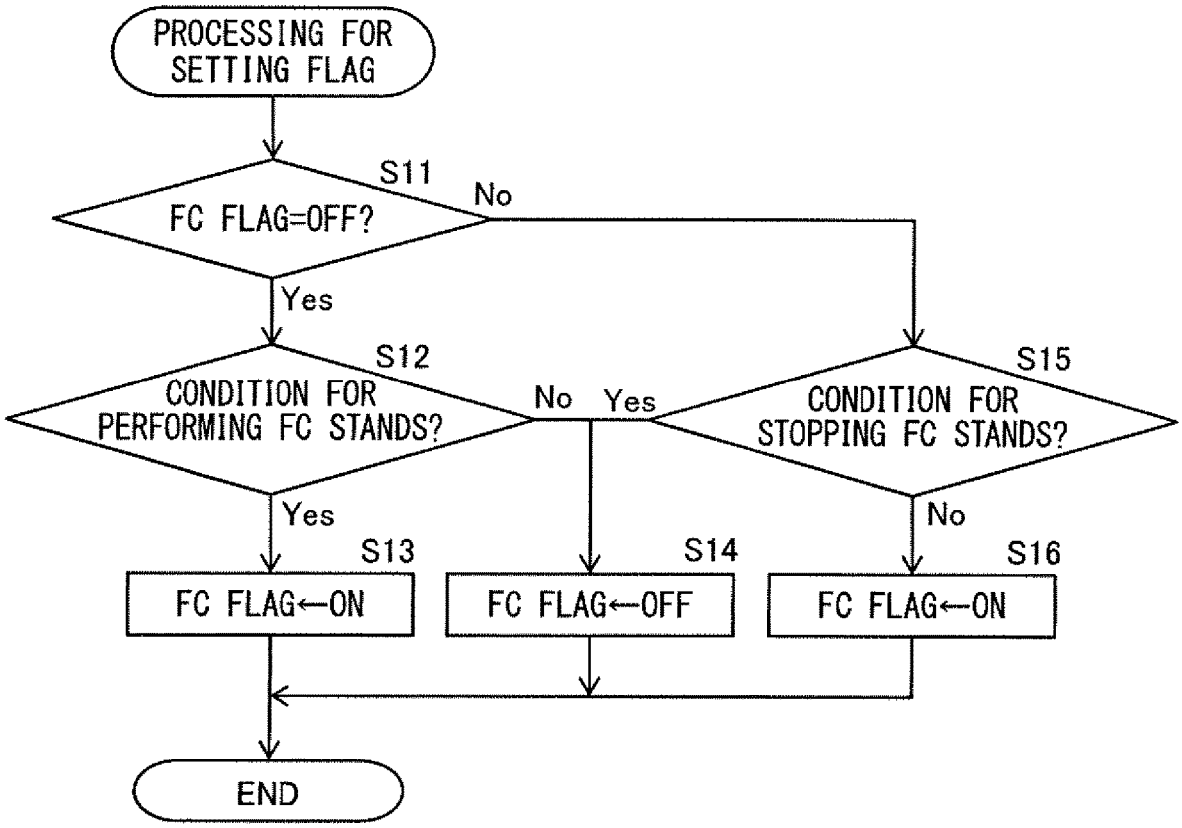
FIG. 5 is a flow chart showing a control routine of flag setting processing for setting the FC flag.

FIG. 5 is a flow chart showing a control routine of flag setting processing for setting the FC flag. The illustrated control routine is performed in the control device every certain time interval.

First, at step S11, it is judged if the FC flag is ON. If at step S11 it is judged that the FC flag is not ON, the routine proceeds to step S12.

At step S12, it is judged if the condition for performing fuel cut control stands. Whether or not the condition for performing fuel cut control stands is, for example, judged based on the engine load or engine rotational speed. Specifically, for example, the condition stands if the amount of depression of the accelerator pedal 43 is zero and thus the engine load detected by the load sensor 44 is zero, the engine rotational speed calculated based on the output of the crank angle sensor 45 is equal to or greater than a predetermined first rotational speed, and the speed of the vehicle mounting the internal combustion engine 1 is equal to or greater than a predetermined speed.

If at step S12 it is judged that the condition for performing fuel cut control does not stand, the routine proceeds to step S14. At step S14, the FC flag is set OFF and the control routine is ended. On the other hand, if at step S12 it is judged that the condition for performing fuel cut control stands, the routine proceeds to step S13. At step S13, the FC flag is set ON and the control routine is made to end.

If the FC flag is set ON, at the next control routine, the routine proceeds from step S11 to step S15. At step S15, it is judged if the condition for ending fuel cut control stands. Whether or not the condition for ending fuel cut control stands is, for example, judged based on the engine load or engine rotational speed. Specifically, the ending condition stands if the engine load detected by the load sensor 44 becomes a value larger than zero, or if the engine rotational speed calculated based on the output of the crank angle sensor 45 is equal to or less than a predetermined second rotational speed (speed lower than first rotational speed), etc.

If at step S15 it is judged that the condition for ending fuel cut control does not stand, the routine proceeds to step S16. At step S16, the FC flag is maintained as set ON, then the control routine is ended. On the other hand, if at step S15 it is judged that the condition for ending fuel cut control stands, the routine proceeds to step S14 where the FC flag is set OFF.

Figure 6:
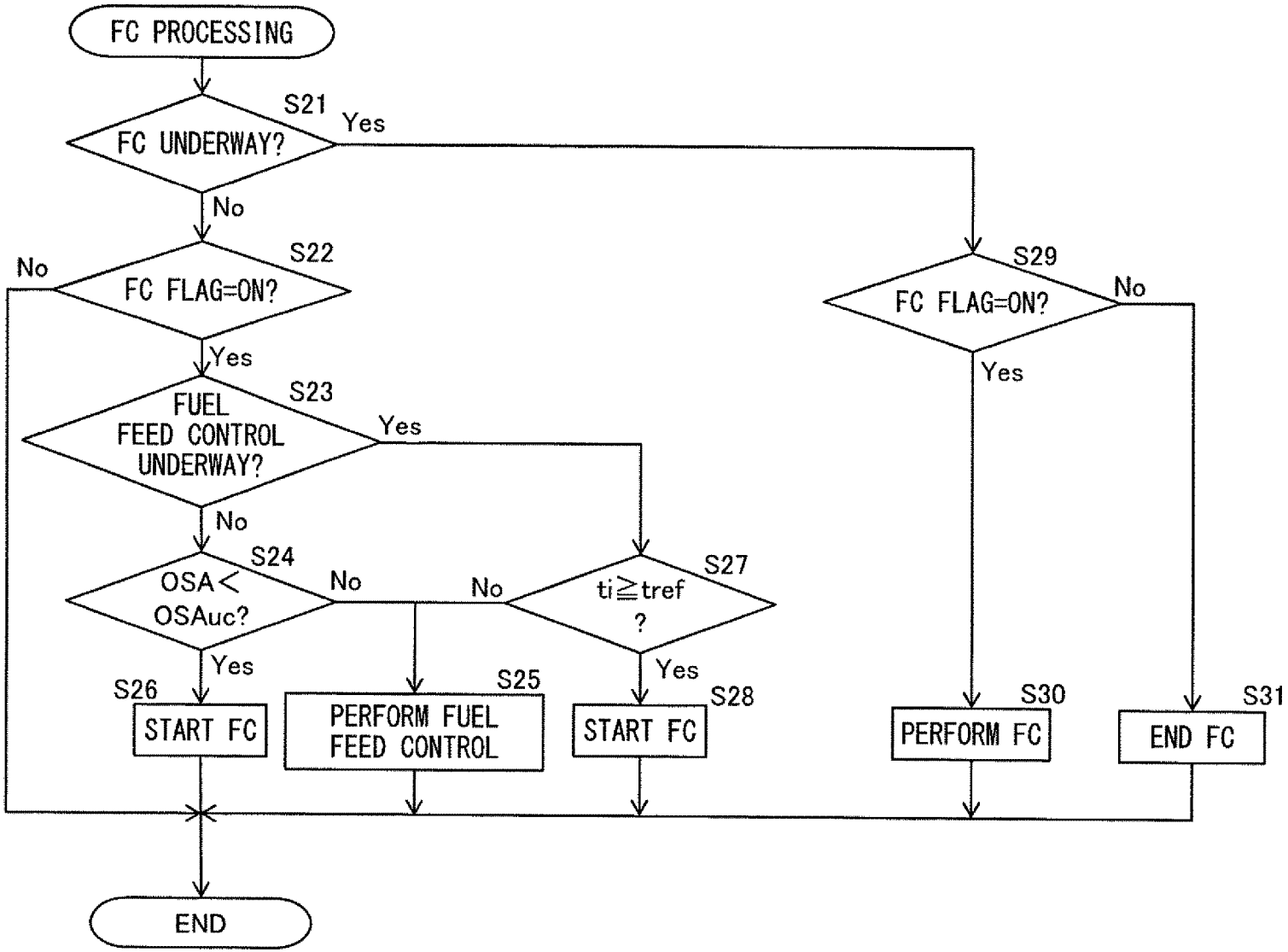
FIG. 6 is a flow chart showing a control routine of fuel cut processing for performing fuel cut control.

FIG. 6 is a flow chart showing a control routine of fuel cut processing for performing fuel cut control. The illustrated control routine is performed in the control device every certain time interval.

First, at step S21, it is judged if fuel cut control is underway. When fuel cut control is not underway, the routine proceeds to step S22. At step S22, it is judged if the FC flag, set by the processing for setting the flag shown in FIG. 5, is ON. If at step S22 it is judged that the FC flag is not ON, the control routine is ended. On the other hand, if at step S22 it is judged that the FC flag is ON, the routine proceeds to step S23. At step S23, it is judged if fuel feed control is currently being performed. If it is judged that fuel feed control is not being performed, the routine proceeds to step S24.

At step S24, it is judged if the current oxygen storage amount OSA of the exhaust purification catalyst 20 is smaller than the reference oxygen storage amount OSAuc. The current oxygen storage amount OSA is, for example, calculated based on the flow rate of the exhaust gas flowing into the exhaust purification catalyst 20 calculated based on the output of the air flow meter 39 and the air-fuel ratio of the exhaust gas detected by the upstream side air-fuel ratio sensor 41 (below, also referred to as the "output air-fuel ratio"). If at step S24 it is judged that the oxygen storage amount OSA is smaller than the reference oxygen storage amount OSAuc, the routine proceeds to step S26 where fuel cut control is started. On the other hand, if at step S24 it is judged that the oxygen storage amount OSA is equal to or greater than the reference oxygen storage amount OSAuc, the routine proceeds to step S25 where fuel feed control is performed.

If fuel feed control is started, at the next control routine, the routine proceeds from step S23 to step S27. At step S27, it is judged if the time ti from starting fuel feed control is equal to or greater than a predetermined reference time tref. If at step S27 it is judged that the time ti is less than the reference time tref, the routine proceeds to step S25 where fuel feed control is continued. On the other hand, if at step S27 it is judged that the time ti is equal to or greater than the reference time tref, the routine proceeds to step S28 where fuel cut control is started.

If fuel cut control is started at step S26 or step S28, at the next control routine, the routine proceeds from step S21 to step S29. At step S29, it is judged if the FC flag is ON. If at step S29 it is judged that the FC flag is ON, fuel cut control is continued via proceeding to step S30. On the other hand, if at step S29 it is judged that the FC flag is not ON, the routine proceeds to step S31 where fuel cut control is ended.

<<Modifications>>

In the above embodiment, the fuel feed control is performed by continuing the state where the air-fuel ratio of the exhaust gas flowing into the exhaust purification catalyst 20 is a predetermined constant rich air-fuel ratio for a predetermined constant time (constant crank angle). However, the rich degree of the air-fuel ratio of the exhaust gas in fuel feed control and the time for performing fuel feed control do not necessarily have to be constant.

Figure 7:
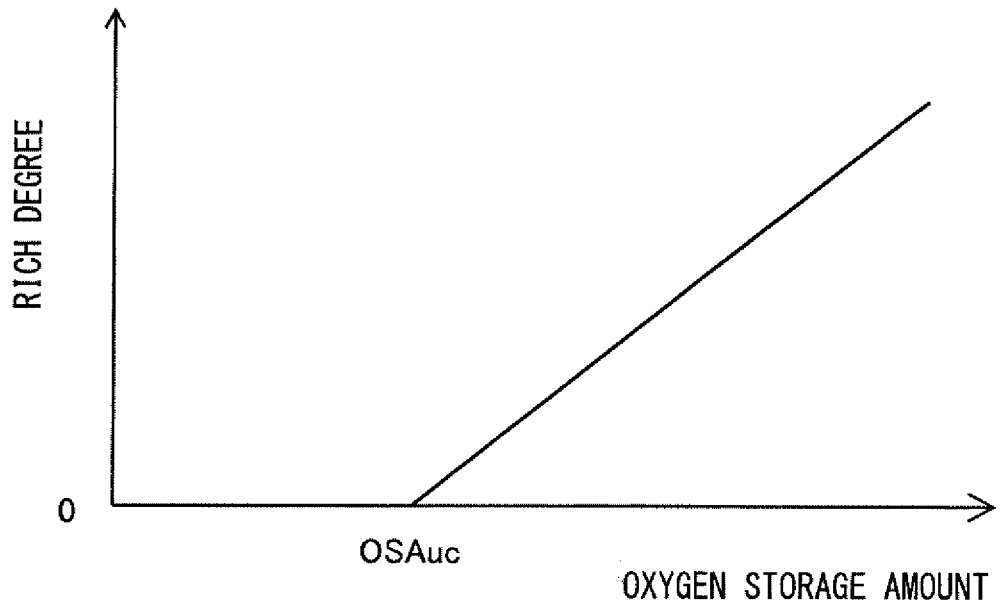
FIG. 7 is a view showing a relationship between the oxygen storage amount of the exhaust purification catalyst and a rich degree of the air-fuel ratio of the exhaust gas.

Referring to FIG. 7, a first modification of the above embodiment will be explained. In the first modification, if the oxygen storage amount OSA of the exhaust purification catalyst 20 when the condition for performing the fuel cut operation stands is relatively large, compared to when it is relatively small, in fuel feed control, the amount of feed of fuel to the combustion chamber 10 is controlled so that the rich degree of the air-fuel ratio of the exhaust gas flowing into the exhaust purification catalyst is larger.

FIG. 7 is a view showing the relationship between the oxygen storage amount of the exhaust purification catalyst 20 and the rich degree of the air-fuel ratio of the exhaust gas flowing into the exhaust purification catalyst 20, in fuel feed control. Specifically, in the present modification, as shown in FIG. 7, if the oxygen storage amount OSA increases over the reference oxygen storage amount OSAuc, the amount of fuel injection is controlled so that the greater the oxygen storage amount OSA, the larger the rich degree in fuel feed control becomes. In the present modification, the time for performing fuel feed control is set a predetermined constant time, therefore it can be said that the greater the oxygen storage amount OSA, the greater the total amount of feed of fuel until starting fuel cut control in fuel feed control. In other words, in the present modification, it can be said as the oxygen storage amount OSA is greater, in fuel feed control, the value calculated by multiplying the amount of exhaust gas flowing into the exhaust purification catalyst 20 per unit time with the rich degree of the air-fuel ratio of the exhaust gas at that time and cumulatively adding the multiplied values over the time of performing fuel feed control, becomes larger.

Figure 8:
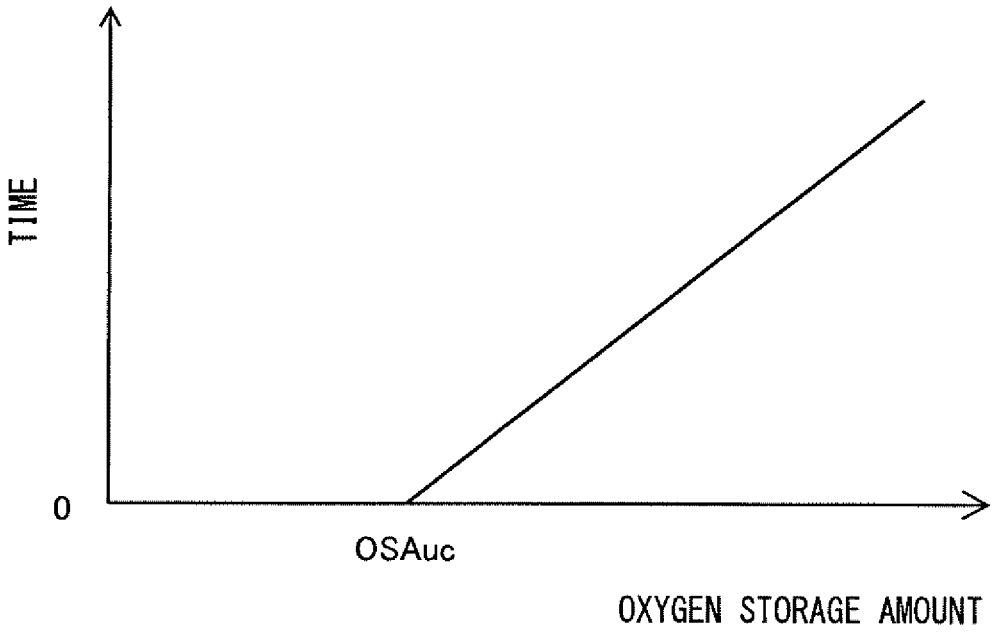
FIG. 8 is a view showing a relationship between the oxygen storage amount of the exhaust purification catalyst and time performing the fuel feed control.

Referring to FIG. 8, a second modification of the above embodiment will be explained. In the second modification, if the oxygen storage amount OSA of the exhaust purification catalyst 20 when the condition for performing the fuel cut operation stands is relatively large, compared with when it is relatively small, the time of performing fuel feed control is set longer.

FIG. 8 is a view showing the relationship between the oxygen storage amount of the exhaust purification catalyst 20 and the time of performing fuel feed control. Specifically, in the present modification, as shown in FIG. 8, if the oxygen storage amount OSA increases over the reference oxygen storage amount OSAuc, the greater the oxygen storage amount OSA, the longer the time of performing fuel feed control (crank angle) becomes. In the present modification, since the rich degree of the air-fuel ratio of the exhaust gas in fuel feed control is set a predetermined constant value, the greater the oxygen storage amount OSA, the greater the amount of feed of fuel in fuel feed control until starting fuel cut control. In other words, in this modification, as the oxygen storage amount OSA is greater, in fuel feed control, the value calculated by multiplying the amount of exhaust gas flowing into the exhaust purification catalyst 20 per unit time with the rich degree of the air-fuel ratio of the exhaust gas at that time and cumulatively adding the multiplied values over the time of performing fuel feed control becomes larger.

If summarizing the above-mentioned first modification and second modification, in these modifications, if the oxygen storage amount OSA of the exhaust purification catalyst 20 when the condition for performing the fuel cut operation stands is relatively large, compared to when it is relatively small, the amount of feed of fuel is controlled so that the total amount of feed of fuel in the fuel feed control until starting fuel cut control is larger. In other words, in these modifications, if the oxygen storage amount OSA of the exhaust purification catalyst 20 when the condition for performing the fuel cut operation stands is relatively large, compared to when it is relatively small, in the fuel feed control, the amount of feed of fuel is controlled so that the value calculated by multiplying the amount of exhaust gas flowing into the exhaust purification catalyst 20 per unit time with the rich degree of the air-fuel ratio of the exhaust gas at that time and cumulatively adding the multiplied values over the time of performing fuel feed control becomes larger.

Figure 9:
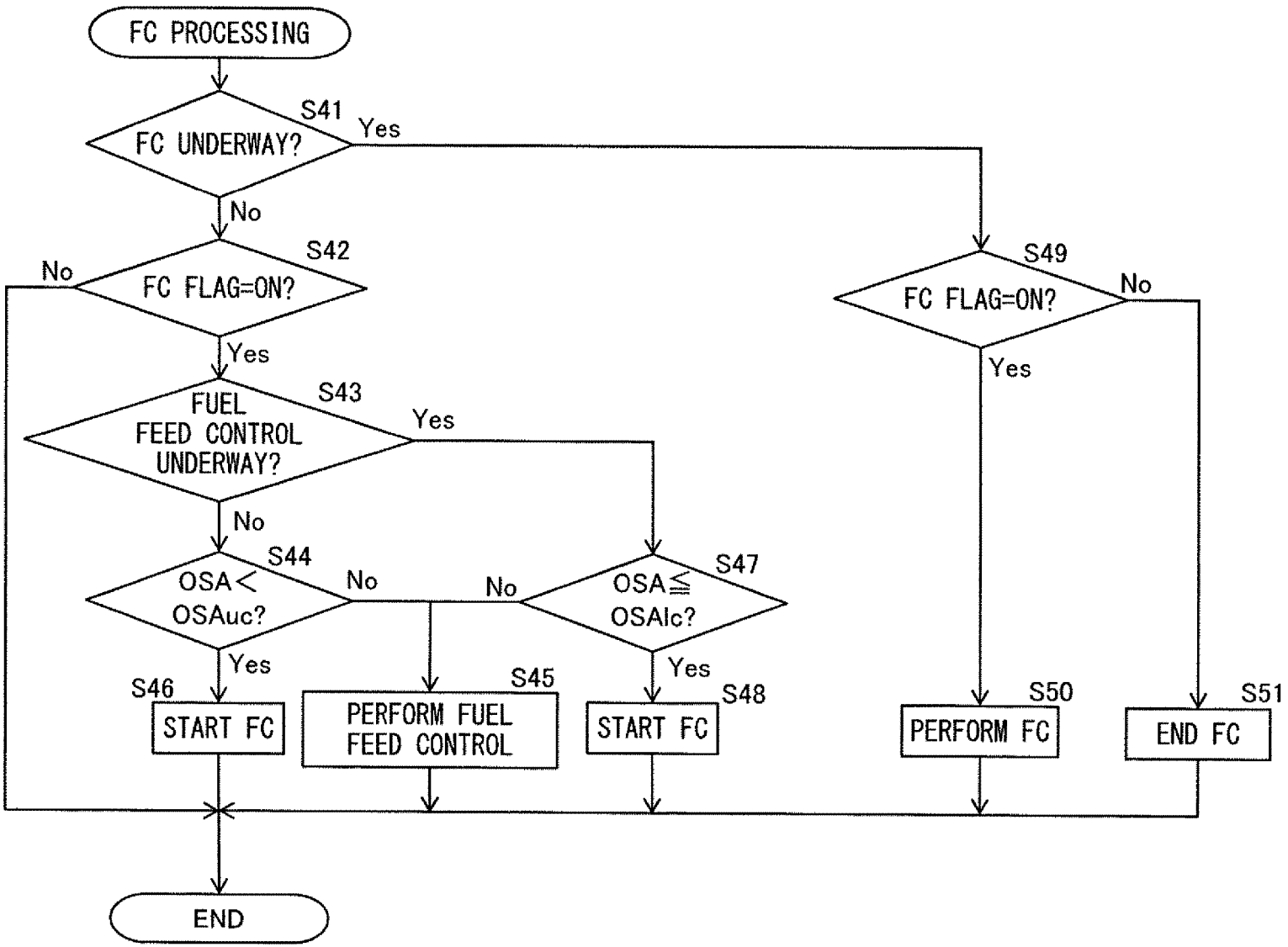
FIG. 9 is a flow chart showing a control routine of fuel cut processing for performing fuel cut control.

Referring to FIG. 9, a third modification of the above embodiment will be explained. In the third modification, during fuel feed control as well, the oxygen storage amount OSA of the exhaust purification catalyst 20 is estimated and fuel feed control is performed until the estimated oxygen storage amount OSA reaches a predetermined lower limit oxygen storage amount OSA1*c* (see FIG. 4). In this regard, the lower limit oxygen storage amount OSA1*c* is set a value of equal to or greater than zero and smaller than the reference oxygen storage amount OSAuc.

FIG. 9 is a flow chart showing a control routine of processing for a fuel cut operation according to a third modification. The illustrated control routine is performed by the control device every constant time interval. Note that, steps S41 to S46 and S48 to S51 of FIG. 9 are respectively similar to steps S21 to S26 and S28 to S31 of FIG. 6, therefore explanations will be omitted.

If at step S43 it is judged that fuel feed control is currently underway, the routine proceeds to step S47. At step S47, it is judged if the current oxygen storage amount OSA is equal to or less than the lower limit oxygen storage amount OSA1*c*. The current oxygen storage amount OSA, like at step S24 of FIG. 6, is, for example, calculated based on the flow rate of the exhaust gas flowing into the exhaust purification catalyst 20 and the air-fuel ratio of the exhaust gas. If it is judged that the current oxygen storage amount OSA is greater than the lower limit oxygen storage amount OSA1*c*, the routine proceeds to step S45 where fuel feed control is continued. On the other hand, if at step S47 it is judged that the current oxygen storage amount OSA is equal to or less than the lower limit oxygen storage amount OSA1*c*, the routine proceeds to step S48 where fuel cut control is started.

Second Embodiment

Next, referring to FIG. 10, an exhaust purification system according to a second embodiment will be explained. The configuration and control of the exhaust purification system according to the second embodiment are basically similar to the configuration and control of the exhaust purification system according to the first embodiment. Below, exhaust purification system according to the second embodiment will be explained focusing on parts different from the first embodiment.

As explained above, if the exhaust purification catalyst 20 increasingly deteriorates, the total surface area of the precious metal becomes smaller due to sintering of the precious metal. If in this way the total surface area of the precious metal becomes smaller, the amount of unburned HC adsorbed at the surface of the precious metal is also reduced. Therefore, when the exhaust purification catalyst 20 increasingly deteriorates, compared to when the exhaust purification catalyst 20 does not deteriorate, even if reducing the total amount of feed of fuel in the fuel feed control, it is possible to sufficiently keep the exhaust purification catalyst 20 from further deteriorating.

Further, if the exhaust purification catalyst 20 increasingly deteriorates, the oxygen storing agent falls in oxygen storage ability. Therefore, if the exhaust purification catalyst 20 increasingly deteriorates, the exhaust purification catalyst 20 falls in the maximum storable oxygen amount. For this reason, even when the exhaust purification catalyst 20 increasingly deteriorates, if performing fuel feed control in the same way as when the exhaust purification catalyst 20 does not deteriorate, the total amount of feed of fuel may become too great, the oxygen storage amount of the exhaust purification catalyst 20 may reach zero, and part of the unburned HC fed to the exhaust purification catalyst 20 by fuel feed control may flow out from the exhaust purification catalyst 20.

Therefore, in the present embodiment, when the degree of deterioration of the exhaust purification catalyst 20 when the condition for fuel cut operation stands is relatively high, compared to when it is relatively low, the total amount of feed of fuel during fuel feed control is made smaller. In other words, in the present embodiment, when the degree of deterioration of the exhaust purification catalyst 20 when the condition for fuel cut operation stands is relatively high, compared to when it is relatively low, the value calculated by multiplying the amount of exhaust gas flowing into the exhaust purification catalyst 20 per unit time with the rich degree of the air-fuel ratio of the exhaust gas at that time and cumulatively adding the multiplied values over the time of performing fuel feed control is set smaller.

Figure 10:
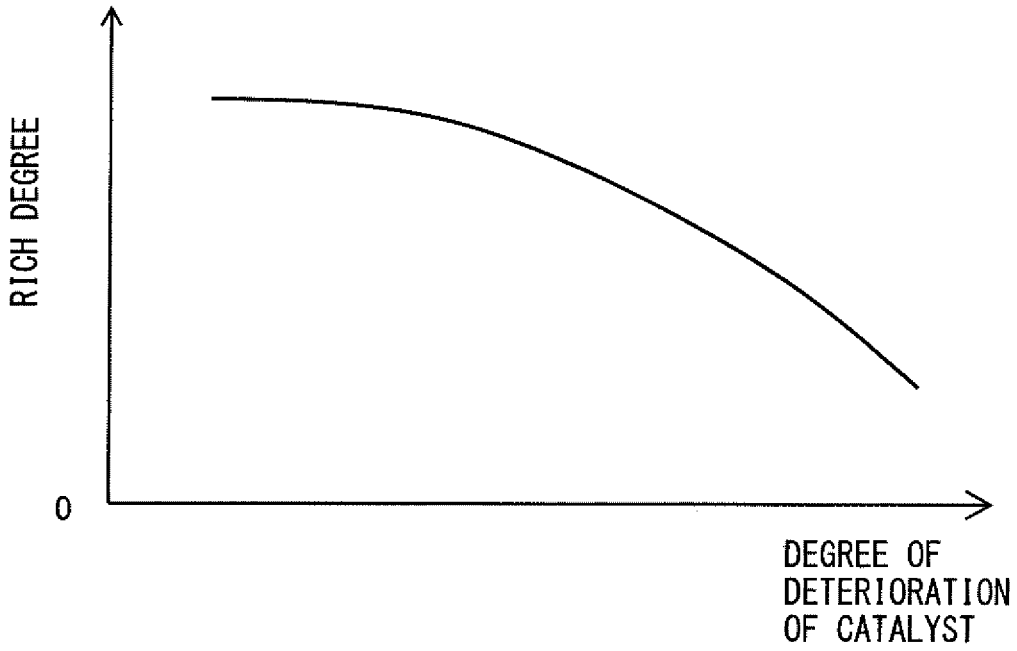
FIG. 10 is a view showing a relationship between a degree of deterioration of the exhaust purification catalyst and a rich degree of the air-fuel ratio of the exhaust gas.

FIG. 10 is a view showing the relationship between a degree of deterioration of the exhaust purification catalyst 20 and a rich degree of the air-fuel ratio of the exhaust gas flowing into the exhaust purification catalyst 20 in fuel feed control. As will be understood from FIG. 10, in the present embodiment, the amount of fuel injection is controlled so that the greater the degree of deterioration of the exhaust purification catalyst 20, the smaller the rich degree in fuel feed control becomes. In the present embodiment, the time of performing fuel feed control is set a predetermined constant time, therefore the greater the degree of deterioration of the exhaust purification catalyst 20, the smaller the total amount of feed of fuel until starting fuel cut control in fuel feed control. In other words, in the present embodiment, the greater the degree of deterioration of the exhaust purification catalyst 20, the smaller the value calculated by multiplying the amount of exhaust gas flowing into the exhaust purification catalyst 20 per unit time with the rich degree of the air-fuel ratio of the exhaust gas at that time and cumulatively adding the multiplied values over the time of performing fuel feed control becomes.

Further, the degree of deterioration of the exhaust purification catalyst 20 is detected by a known method. Specifically, for example, it is detected by the following method. First, in the state where the output air-fuel ratio of the downstream side air-fuel ratio sensor 42 is a rich air-fuel ratio, the air-fuel ratio of the exhaust gas flowing into the exhaust purification catalyst 20 is changed to a lean air-fuel ratio and is maintained as is until the output air-fuel ratio of the downstream side air-fuel ratio sensor 42 becomes a lean air-fuel ratio. Then, the degree of deterioration of the exhaust purification catalyst 20 is estimated based on the total amount of excess oxygen flowing into the exhaust purification catalyst 20 from when the air-fuel ratio of the exhaust gas flowing into the exhaust purification catalyst 20 is changed to a lean air-fuel ratio to when the output air-fuel ratio of the downstream side air-fuel ratio sensor 42 becomes a lean air-fuel ratio (alternatively, the value cumulatively adding the amount of exhaust gas flowing into the exhaust purification catalyst 20 per unit time multiplied with the lean degree of the air-fuel ratio of the exhaust gas at that time). The smaller the total amount of excess oxygen at this time, the higher the degree of deterioration of the exhaust purification catalyst 20 that is estimated.

Alternatively, the air-fuel ratio of the exhaust gas flowing into the exhaust purification catalyst 20 is changed to a rich air-fuel ratio in the state where the output air-fuel ratio of the downstream side air-fuel ratio sensor 42 is a lean air-fuel ratio and is maintained until the output air-fuel ratio of the downstream side air-fuel ratio sensor 42 becomes a rich air-fuel ratio. Then, the degree of deterioration of the exhaust purification catalyst 20 is estimated based on the total amount of the excess unburned HC or CO flowing into the exhaust purification catalyst 20 from when the air-fuel ratio of the exhaust gas flowing into the exhaust purification catalyst 20 is changed to a rich air-fuel ratio to when the output air-fuel ratio of the downstream side air-fuel ratio sensor 42 becomes a rich air-fuel ratio (alternatively, the value cumulatively adding the amount of exhaust gas flowing into the exhaust purification catalyst 20 per unit time multiplied with the rich degree of the air-fuel ratio of the exhaust gas at that time). The smaller the total amount of excess oxygen at this time, the higher the degree of deterioration of the exhaust purification catalyst 20 that is estimated.

According to the present embodiment, when the exhaust purification catalyst 20 increasingly deteriorates, compared with when the exhaust purification catalyst 20 does not deteriorate, the total amount of fuel feed during fuel feed control is set smaller, therefore the exhaust purification catalyst 20 can be kept from deteriorating while the amount of feed of fuel can be reduced. For this reason, the fuel efficiency can be kept from deteriorating. In addition, unburned HC can be kept from flowing out from the exhaust purification catalyst 20.

Note that, in the present embodiment, the total amount of feed in fuel feed control is controlled based on only the degree of deterioration of the exhaust purification catalyst 20. However, considering the modification of the first embodiment, it may also be changed based on the oxygen storage amount of the exhaust purification catalyst 20, etc. In this case, for example, the amount of feed of fuel is controlled so that the greater the degree of deterioration of the exhaust purification catalyst 20 and the smaller the oxygen storage amount of the exhaust purification catalyst 20, the smaller the total amount of feed of fuel during fuel feed control becomes.

Third Embodiment

Next, referring to FIGS. 11 and 12, an exhaust purification system according to a third embodiment will be explained. The configuration and control of the exhaust purification system according to the third embodiment are basically similar to the configuration and control of the exhaust purification system according to the first embodiment. Below, exhaust purification system according to the third embodiment will be explained focusing on parts different from the first embodiment.

In this regard, if the amount of adsorption of unburned HC per unit surface area of the precious metal of the exhaust purification catalyst 20 becomes greater, the catalytic action by the precious metal falls. If, in such a state, a large amount of unburned HC flows into the exhaust purification catalyst 20 due to fuel feed control, part of the inflowing unburned HC may flow out as is from the exhaust purification catalyst 20 without being removed at the exhaust purification catalyst 20.

Therefore, in the present embodiment, if the amount of adsorption of hydrocarbons at the exhaust purification catalyst 20 when the condition for a fuel cut operation stands is equal to or greater than a predetermined reference adsorption amount, fuel cut control is performed without fuel feed control being performed. In addition, in the present embodiment, if the amount of adsorption of hydrocarbons at the exhaust purification catalyst 20 when the condition for a fuel cut operation stands is less than the reference adsorption amount, the amount of feed of fuel to the combustion chamber 10 is controlled so that the greater the amount of adsorption of hydrocarbons at the exhaust purification catalyst 20, the smaller the amount of feed of fuel per unit time in the fuel feed control.

Figure 11:
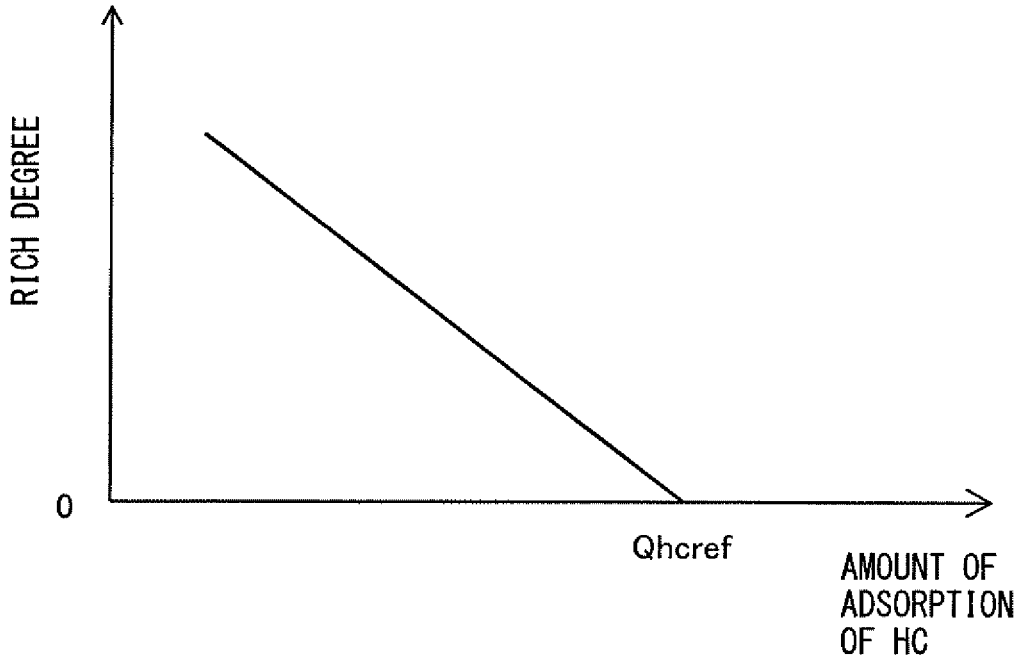
FIG. 11 is a view showing a relationship between an amount of adsorption of unburned HC at the exhaust purification catalyst and a rich degree of the air-fuel ratio of the exhaust gas.

FIG. 11 is a view showing the relationship between the amount of unburned HC adsorbed at the exhaust purification catalyst 20 and the rich degree of the air-fuel ratio of the exhaust gas flowing into the exhaust purification catalyst 20 in fuel feed control. As will be understood from FIG. 11, in the present embodiment, if the amount of adsorption of the unburned HC is equal to or greater than the reference adsorption amount Qhcref, no fuel feed control is performed and accordingly the rich degree is also zero.

On the other hand, if the amount of unburned HC adsorbed at the exhaust purification catalyst 20 is smaller than the reference adsorption amount Qhcref, as shown in FIG. 11, the amount of fuel injection to the combustion chamber 10 is controlled so that the greater the amount of adsorption of unburned HC, the smaller the rich degree at fuel feed control.

According to the present embodiment, when the amount of unburned HC adsorbed at the exhaust purification catalyst 20 is large, that is, when the amount of adsorption of unburned HC per unit surface area of the precious metal is large, fuel feed control is not performed. For this reason, unburned HC is kept from flowing out from the exhaust purification catalyst 20. Further, the greater the amount of unburned HC adsorbed at the exhaust purification catalyst 20, the smaller the catalytic action of the precious metal. In that regard, in the present embodiment, the greater the amount of adsorption of the unburned HC, the smaller the rich degree is made, therefore it is possible to sufficiently remove the unburned HC even if the catalytic action is small. Due to this as well, unburned HC is kept from flowing out from the exhaust purification catalyst 20.

Note that, in the present embodiment, the rich degree at the fuel feed control is controlled based on the amount of unburned HC adsorbed at the exhaust purification catalyst 20. However, in addition to such control, it is also possible to control the total amount of feed of fuel to the exhaust purification catalyst 20 during fuel feed control based on the oxygen storage amount of the exhaust purification catalyst 20, etc., in consideration of the first embodiment and second embodiment.

<<Specific Control>>

Figure 12:
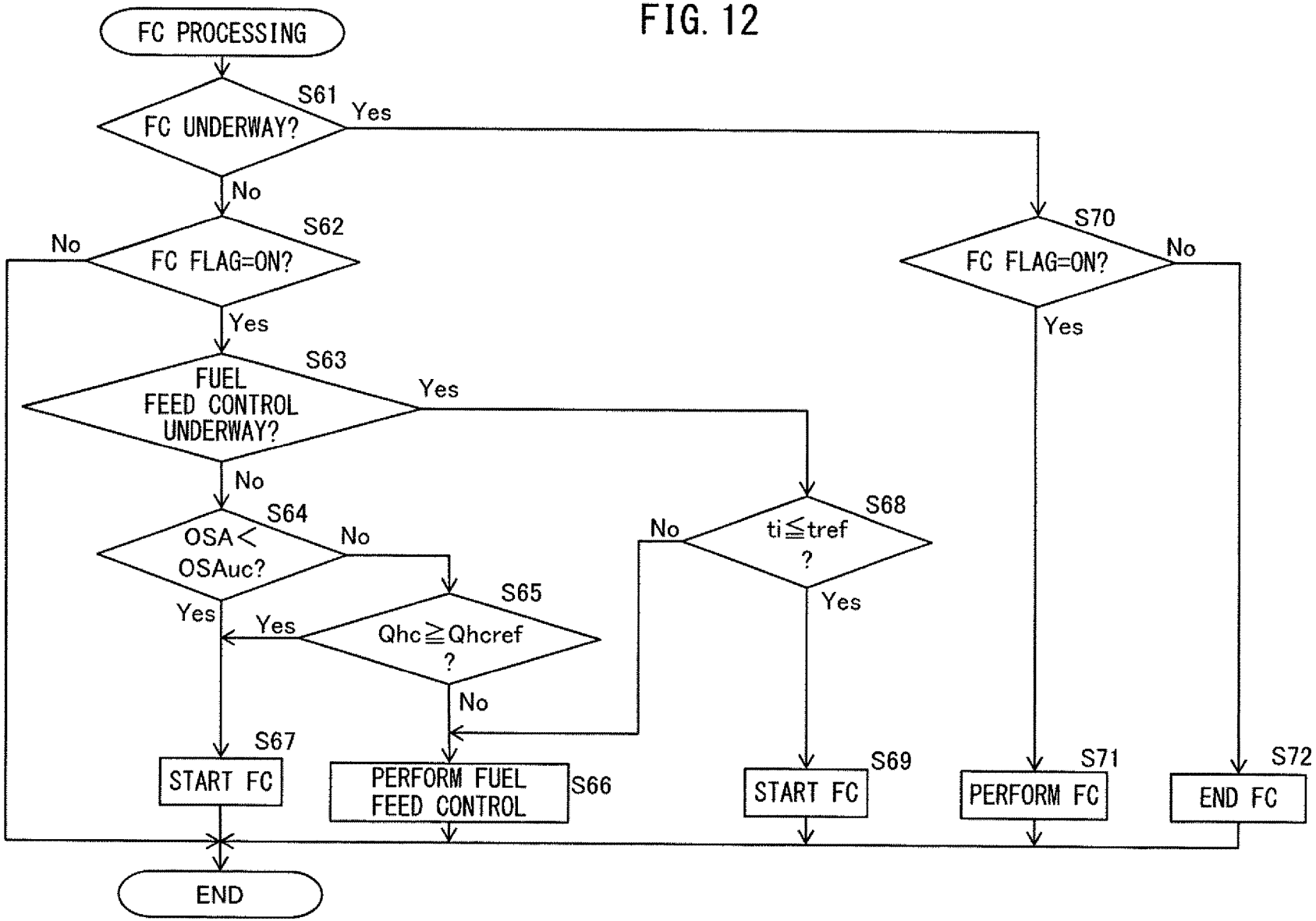
FIG. 12 is a flow chart showing a control routine of fuel cut processing.

FIG. 12 is a flow chart showing a control routine of processing for a fuel cut operation according to the third embodiment. The illustrated control routine is performed by the control device every constant time interval. Note that, steps S61 to S64 and S66 to S72 of FIG. 12 are respectively similar to steps S21 to S24 and S25 to S31 of FIG. 6, therefore explanations will be omitted.

If at step S64 it is judged that the oxygen storage amount OSA is equal to or greater than the reference oxygen storage amount OSAuc, the routine proceeds to step S65. At step S65, it is judged if the amount of unburned HC adsorbed at the exhaust purification catalyst 20 is equal to or greater than a reference adsorption amount Qhcref.

The amount of unburned HC adsorbed at the exhaust purification catalyst 20 is, for example, estimated based on the flow rate of the unburned HC flowing into the exhaust purification catalyst 20 and the temperature of the exhaust purification catalyst 20. The flow rate of the unburned HC flowing into the exhaust purification catalyst 20 is, for example, calculated based on the flow rate of the exhaust gas flowing into the exhaust purification catalyst 20 (for example, estimated based on the output of the air flow meter 39) and the output air-fuel ratio of the downstream side air-fuel ratio sensor 42. The temperature of the exhaust purification catalyst 20, for example, is detected by a temperature sensor (not shown) detecting the temperature of the exhaust purification catalyst 20.

Specifically, the adsorption amount is calculated based on that the greater the flow rate of the unburned HC flowing into the exhaust purification catalyst 20, the greater the amount of unburned HC adsorbed at the exhaust purification catalyst 20. Further, the adsorption amount is calculated based on that the lower the temperature of the exhaust purification catalyst 20, the greater the amount of unburned HC adsorbed at the exhaust purification catalyst 20.

If at step S65, the amount of unburned HC adsorbed at the exhaust purification catalyst 20 is equal to or greater than the reference adsorption amount Qhcref, the routine proceeds to step S67 where fuel cut control is started. On the other hand, if at step S65 it is judged that the amount of unburned HC adsorbed at the exhaust purification catalyst 20 is smaller than the reference adsorption amount Qhcref, the routine proceeds to step S66 where fuel feed control is performed. At this time, the rich degree of the air-fuel ratio of the exhaust gas flowing into the exhaust purification catalyst 20 is set based on the amount of adsorption of the unburned HC using a map such as shown in FIG. 11.

REFERENCE SIGNS LIST

1. internal combustion engine
2. engine body
10. combustion chamber
12. fuel injector
20. exhaust purification catalyst
31. electronic control unit (ECU)
41. upstream side air-fuel ratio sensor
42. downstream side air-fuel ratio sensor

The invention claimed is:

1. An exhaust purification system of an internal combustion engine, comprising:

an exhaust purification catalyst supporting a precious metal and being able to store oxygen; and a control device including executable instructions stored in a non-transitory media for:

determining an operating condition for the internal combustion engine via at least one sensor, and controlling an amount of fuel fed to a combustion chamber; wherein the executable instructions are provided such that when a predetermined condition for performing a fuel cut operation is detected via the least one sensor:

the control device initiates a fuel feed control during which fuel is temporarily fed to the combustion chamber so that a rich air-fuel ratio of the exhaust gas flowing into the exhaust purification catalyst is achieved, the rich air-fuel ratio being richer than the stoichiometric air-fuel ratio, and then the control device initiates a fuel cut control, the fuel cut control stopping the feed of the fuel to the combustion chamber in a state where the internal combustion engine is operating, the executable instructions including a proviso that the control device perform the fuel cut control without performing the fuel feed control if an assessed value of an amount of adsorption of hydrocarbons at the exhaust purification catalyst, during a period when the predetermined condition for performing the fuel cut operation is being detected, is determined to be equal to or greater than a predetermined reference adsorption amount.

2. The exhaust purification system of the internal combustion engine according to claim 1, wherein the control device further includes executable instructions to adjust an amount of the fuel fed into the combustion chamber based on an assessed oxygen storage amount of the exhaust purification catalyst, the amount of the fuel fed into the combustion chamber being adjusted so that a total amount of the fuel fed into the combustion chamber during the fuel feed control becomes greater as the assessed value of the oxygen storage amount of the exhaust purification catalyst increases.

3. The exhaust purification system of the internal combustion engine according to claim 2, wherein the executable instructions further include a proviso that the amount of the fuel fed into the combustion chamber is adjusted so that a rich degree of the air-fuel ratio of the exhaust gas flowing into the exhaust purification catalyst during the fuel feed control becomes greater as the assessed value of the oxygen storage amount of the exhaust purification catalyst increases.

4. The exhaust purification system of the internal combustion engine according to claim 1, wherein the control device further includes executable instructions to perform an immediate fuel cut control without performing the fuel feed control even if the predetermined condition for performing the fuel cut operation is being detected, the immediate fuel cut control being performed without the fuel feed control if an assessed value of an oxygen storage amount of the exhaust purification catalyst is determined to be smaller than a predetermined reference oxygen storage amount, wherein the predetermined reference oxygen storage amount is smaller than a maximum storable oxygen amount of the exhaust purification catalyst, and the predetermined reference oxygen storage amount is greater than zero.

5. The exhaust purification system of the internal combustion engine according to claim 1, wherein the control device further includes executable instructions to adjust an amount of the fuel fed into the combustion chamber based on an assessed degree of deterioration of the exhaust purification catalyst, the amount of the fuel fed into the combustion chamber being adjusted so that a total amount of the fuel fed into the combustion chamber during the fuel feed control becomes smaller as the assessed value of the degree of deterioration of the exhaust purification catalyst increases.

6. The exhaust purification system of the internal combustion engine according to claim 1, wherein the control device further includes executable instructions to adjust a rich degree of the air-fuel ratio of the exhaust gas flowing into the exhaust purification catalyst during the fuel feed control based on the amount of adsorption of hydrocarbons determined to be at the exhaust purification catalyst, and the executable instructions further including a proviso that if the assessed value of the amount of adsorption of hydrocarbons at the exhaust purification catalyst is determined to be less than the reference adsorption amount, the rich degree of the air-fuel ratio of the exhaust gas flowing into the exhaust purification catalyst is adjusted such that the rich degree of the air-fuel ratio of the exhaust gas flowing into the exhaust purification catalyst during the fuel feed control becomes smaller as the assessed value of the amount of adsorption of hydrocarbons determined to be at the exhaust purification catalyst increases.

7. The exhaust purification system of the internal combustion engine according to claim 1, wherein the operating condition for the internal combustion engine being determined via the at least one sensor is an engine load or an engine rotational speed.

8. The exhaust purification system of the internal combustion engine according to claim 7, wherein the at least one sensor comprises a load sensor, and the predetermined condition for performing the fuel cut operation is based on whether the engine load detected by the load sensor is zero.

9. The exhaust purification system of the internal combustion engine according to claim 7, wherein the at least one sensor comprises a crank angle sensor, and the predetermined condition for performing the fuel cut operation is based on:

whether the engine rotational speed calculated based on an output of the crank angle sensor is equal to or greater than a predetermined rotational speed, and whether a speed of a vehicle mounting the internal combustion engine is equal to or greater than a predetermined speed.

* * * * *